United States Patent [19]

Hosomizu

[11] 4,377,774

[45] Mar. 22, 1983

[54] ELECTRONIC FLASH CONTROL DEVICE

[75] Inventor: Hiroshi Hosomizu, Osaka, Japan

[73] Assignee: Minolta Camera Kabushiki Kaisha, Osaka, Japan

[21] Appl. No.: 129,996

[22] Filed: Mar. 13, 1980

Related U.S. Application Data

[63] Continuation of Ser. No. 839,188, Oct. 4, 1977, abandoned.

[30] Foreign Application Priority Data

Oct. 15, 1976 [JP] Japan ..... 51-124103

[51] Int. Cl.[3] ..... H05B 41/32

[52] U.S. Cl. ..... 315/241 P; 354/145

[58] Field of Search ..... 315/151, 241 P; 354/33, 354/145

[56] References Cited

U.S. PATENT DOCUMENTS

| | | | |
|---|---|---|---|
| Re. 28,783 | 4/1976 | Ackermann | 315/151 |
| 3,683,233 | 8/1972 | Heintze | 315/241 P X |
| 3,710,701 | 1/1973 | Takishima et al. | 315/241 P X |
| 3,714,872 | 2/1973 | Mashimo | 315/241 P X |
| 3,906,292 | 9/1975 | Takahashi | 315/241 P X |
| 3,978,370 | 8/1976 | Stieringer | 315/159 X |

*Primary Examiner*—Eugene R. LaRoche
*Attorney, Agent, or Firm*—Watson, Cole

[57] ABSTRACT

A control circuit controls the amount of light emitted from an electronic flash tube in accordance with the voltage of a main capacitor, which energizes the flash tube, and a set guide number so that the amount of light may be constant irrespective of changes in the voltage of the main capacitor due to consumption of a power source battery from which electric energy is supplied to the main capacitor. The control circuit may include a storing or memorizing capacitor for storing a signal corresponding to the voltage of the main capacitor and further include a transistor which generates a current commensurate with the stored signal, the current being integrated to actuate a flash emission stopping circuit when the integration reaches a given level.

6 Claims, 14 Drawing Figures

ELECTRONIC FLASH CONTROL DEVICE

This is a continuation, of application Ser. No. 839,188 filed Oct. 4, 1977, abandoned.

BACKGROUND OF THE INVENTION

1. Field of the Invention

This invention relates to an electronic flash device equipped with an electronic flash tube which is energized by discharge current of a main capacitor to emit light, and more particularly to such circuitry which includes means for controlling the amount of light emitted by the flash device.

2. Description of the Prior Art

FIG. 1 shows part of the circuitry of a prior art electronic flash device, in which integrating capacitor C and variable resistor R constitute a time constant circuit to which electric power starts to be applied from an energizing circuit (not shown), simultaneously with the commencement of emission of light of an electronic tube, whereby charging of the capacitor C is initiated. A base of transistor Q is connected to the junction between integrating capacitor C and variable resistor R. Then when the base potential thereof reaches a given reference level, a given time after the commencement of charging of integrating capacitor C, transistor Q is turned from a non-conducting condition to a conducting condition, with the result that a voltage is suddenly applied at terminal A. When the voltage is applied to terminal A, then a light-emission-interrupting circuit (not shown) is operated, thereby interrupting the feeding of a current from capacitor C1 to an electronic flash tube, so that the emission of light from the electronic flash tube is stopped. Variable resistor R is adjustable to vary its resistance value in accordance with a guide number setting. That is, when the guide number is set to a smaller value, then the resistance value of resistor R is reduced, hence the current flowing through the resistor is increased, and then integrating capacitor C is charged more quickly, so that the emission of light may be stopped before the termination of discharge of the main capacitor.

Assume that the aforesaid prior art electronic flash device is coupled with a camera of the type having an automatic wind-up mechanism which enables continuous shootings, and that with such a camera, flash photographs are carried out successively in series with guide number being kept constant. Upon the first photograph, with the electric power source switch for the flash device closed beforehand, then the main capacitor is charged sufficiently, so that sufficient light for the set guide number may be emitted from an electronic flash tube. The charging current for the integrating capacitor C is determined according to the set guide number so that the light-emitting time for an electronic flash tube may be constant for the constant guide number, whereas the quantity of light emitted per unit time from the electronic flash tube varies depending the charged condition of the main capacitor. Consequently, in case the charging of the capacitor is delayed due to consumption of the battery, then in the photographs following the first there is a successive lessening of the total quantity of light from the electronic flash tube, thus resulting in insufficient exposure of the film. This is particularly true in the case of a direct or series control type electronic flash device, wherein the emission of light of the electronic flash tube may be interrupted due to the interruption of discharge of the main capacitor. In other words, when the photography is repeated with an insufficient charging condition of the main capacitor, then the residual charges remaining in the main capacitor gradually decreases, so that in the successive photographs, the total quantity of light from the electronic flash tube is reduced per photograph, thus resulting in a difference in exposure level among pictures. In case a single picture is to be taken, even if a picture is taken in an under-exposure condition, it is of no consequence because of the absence of other pictures to be compared therewith. In contrast thereto, in case of successive photography, wherein the same photographic object is taken successively in a plurality of pictures, the difference in exposure condition between the first picture and the successive ones can be easily recognized and such difference gives the pictures a bad impression.

FIGS. 2 (*a*), (*b*), (*c*) and (*d*) show the charging condition of the aforesaid integrating capacitor and the light-emitting condition of the electronic flash tube. FIG. 2 (*a*) refers to a variation in charge current for an integrating capacitor with respect to time, FIG. 2 (*b*) refers to a variation in charge voltage for an integrating capacitor with respect to time, FIG. 2 (*c*) refers to a variation in voltage of the main capacitor at discharging condition with respect to time, and FIG. 2 (*d*) refers to a variation in intensity of light emitted from the electronic flash tube, wherein, throughout the figures, solid lines represent the case where the main capacitor is charged to a sufficient level, and broken lines represent the case where the main capacitor is charged insufficiently. As can be seen from these figures, the charge voltage for the integrating capacitor C reaches a reference level VS a given time after an initiation of flash firing, in accordance with the set guide number, irrespective of the charge voltage for the main capacitor, with the result that the light-emitting duration of an electronic flash tube may be maintained constant depending only on the set guide number, while the quantity of light per unit time variess, thus resulting in a difference in total light quantity to be emitted.

To cope with this, there has been proposed an attempt to measure directly the light emitted from the flash tube with a light receiving element facing the tube, and to interrupt the light emission of the electronic flash tube when an integration of the quantity of light measured by the light receiving element reaches a given level. However, this attempt involves difficulty in making uniform the characteristic of the light receiving elements, and requires the provision of a diaphragm or ND filter so as to limit the intensity of light incident on the light receiving element, with the accompanying complicated construction.

As an alternative, a device may be conceived in which a resistor is connected in series with an electronic flash tube in a discharge path for a main capacitor, so that a voltage drop across the resistor upon discharge of the main capacitor is detected to control the light-emitting time of the electronic flash tube in accordance with the detected value. This device, however, still involves a problem of a lower light-emitting efficiency of an electronic flash tube, due to energy loss in the resistor.

SUMMARY OF THE INVENTION

It is a primary object of the present invention to provide an electronic flash device which, even in case the charging of a main capacitor is delayed due to the consumption of a power source battery, enables the electronic flash tube to emit a desired quantity of light, without lowering of the light-emitting efficiency nor requiring a complicated mechanism or adjustment.

According to the present invention, there is provided electronic flash control circuitry, in which a potential of a main capacitor before the light emission of an electronic flash tube, or a potential corresponding thereto is stored in storing means and a current commensurate with the potential thus stored is supplied to an integrating capacitor as the electronic flash is emitting light. Thereby, when a charge potential for the main capacitor is lower than a standard level, then the light-emitting duration of the electronic flash tube is lengthened in reverse proportion thereto, so that the total light quantity of the electronic flash tube may be maintained constant.

More particularly, according to the electronic flash device of the present invention, a potential of the main capacitor before the firing of the electronic flash tube is detected and stored in a storing means, and then a current commensurate with the value thus stored in the storing means is supplied to an integrating capacitor. The integration being initiated simultaneously with the commencement of light-emission of the electronic flash tube, so that when the integrating capacitor is charged to a given reference level, then the emission of light from the electronic flash tube may be interrupted. As a result, the light-emitting duration of the electronic flash tube varies commensurately with the charge potential for the main capacitor, and the quantity of light emitted may be maintained substantially constant, irrespective of the initial potential of the main capacitor i.e. the potential before flash firing. Accordingly, even if the charging of the main capacitor is delayed due to the consumption of an electric power source, especially in case of continuous photography with an automatic winding system, so that a picture is taken before the potential of the main capacitor reaches a desired level, an optimum exposure may be achieved. Unlike the electronic flash device wherein a resistor is connected in series with an electronic flash tube to control the light emitting duration of the flash tube in accordance with detection of a voltage drop across the aforesaid resistor, or an electronic flash device which receives light directly from an electronic flash tube and then integrates the intensity of the light, the electronic flash device according to the present invention is free of a lowering of the light-emitting efficiency, and complex construction and adjustment. In addition, according to the present invention, over charging of the main capacitor may be prevented by shortening the light-emitting duration of an electronic flash tube, thereby dispensing with a specific mechanism to prevent the over charging.

Meanwhile, the current to be supplied to the integrating capacitor may be of a positive value or a negative value. In case the current is positive, then the device will be of the charging type, and when the current is of negative, then the device will be of the discharging type.

In addition, if a set resistor for introducing a guide number is provided, and the current to be supplied to an integrating capacitor is made dependent on the resistance value of the resistor, as well, then the light-emitting duration of an electronic flash tube may be adjusted to be not so long, by setting the guide member commensurate with the time required for one cycle of photography, in case the electronic flash device is associated with a camera capable of continuous photography by an automatic winding system.

DETAILED DESCRIPTION OF THE PREFERRED EMBODIMENTS

Figure 1:
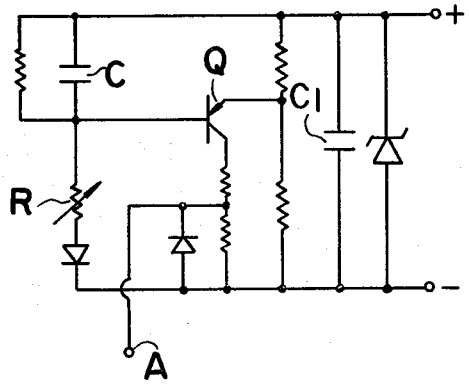
FIG. 1 PRIOR ART
FIG. 1 is a schematic of a part of the circuit of a prior art electronic flash device.
Figure 3:
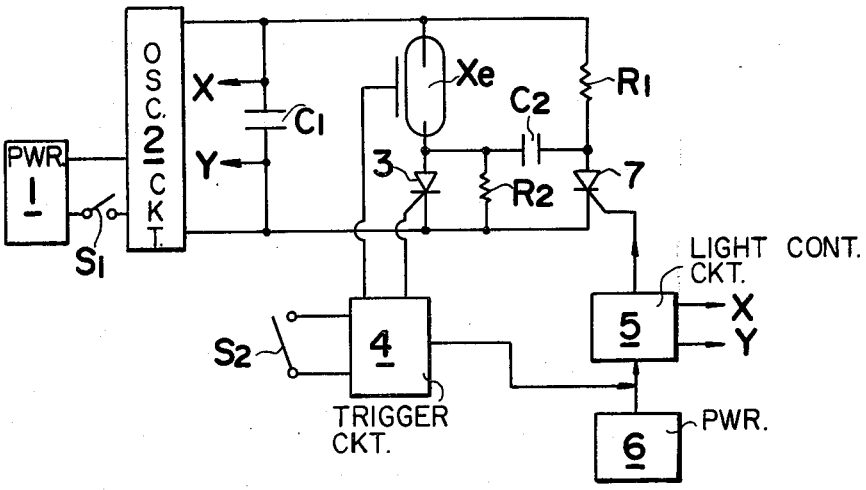
FIG. 3 is a block diagram of circuitry of the first embodiment of the present invention.

FIG. 3 shows the first embodiment of the invention. An electric power source 1 is connected through a power source switch S1, to an oscillator circuit 2 for obtaining high D.C. voltage. Main capacitor C1 is charged through the oscillator circuit 2 at a rate commensurate with a voltage at electric power source 1, when switch S1 is closed. A xenon discharge tube Xe is adapted to emit light due to the discharge of main capacitor C1, and the xenon discharge tube Xe is connected via SCR3 to the opposite ends of main capacitor C1. Trigger circuit 4 is adapted to be actuated by the closure of a synchro-switch S2 in a camera for triggering SCR3. Light control circuit 5 controls the light-emitting duration of xenon discharge tube Xe, and electric power source 6 supplies power for the light control circuit 5. Trigger circuit 4 controls the energization of the light control circuit, and energizes the light control circuit 5 simultaneously with the commencement of the light-emission of xenon discharge tube Xe. SCR 7 is connected via resistor R1 to a series connection of xenon discharge tube Xe and SCR3, and is adapted to be triggered by means of light control circuit 5. A commutation capacitor C2 is connected in parallel with SCR 7 via resistor R2, with one end of the capacitor C2 being connected to the junction between xenon discharge tube Xe and SCR 3. Capacitor C2 is charged via resistors R1, R2 during the cut-off condition of SCR 7, and forcibly lowers the charge potential at the junction of SCR 3 and xenon discharge tube Xe for cutting off SCR 3 simultaneously when SCR 7 is made conductive.

Figure 4:
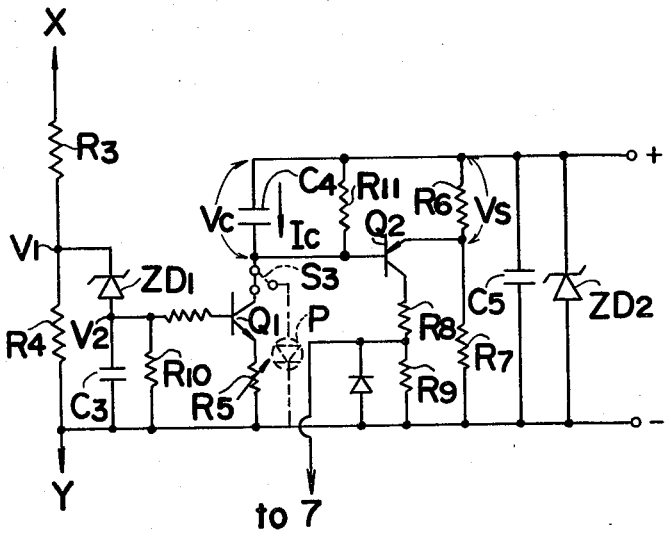
FIG. 4 is detailed circuit diagram of a light control circuit 5 in FIG. 3.

FIG. 4 shows the arrangement of the light control circuit 5. Resistors R3 and R4 form a voltage divider connected across the main capacitor C1 through terminals X and Y, while memory capacitor C3 is connected via zener diode ZD1 across resistor R4. Zener diode ZD1 serves to subtract a given voltage from that across the resistor R4 while the latter voltage is applied to memory capacitor C3, so that when the potential across resistor R4 decreases by some degree, then the charge potential of memory capacitor C1 is lowered in proportion thereto. Meanwhile, memory capacitor C3 and resistor R4 are so designed that the time constant of the circuit consisting of memory capacitor C3 and resistor R4 may be sufficiently large. Accordingly, even if the potential at the junction between resistors R3 and R4 is lowered rapidly due to the discharge of main capacitor C1, the charge potential V2 at memory capacitor C3 may be retained for a while.

A transistor Q1 is adapted to charge integrating capacitor C4 with a current Ic of an amount commensurate with the set guide number and the voltage V2 of the memory capacitor C3, and the base of transistor Q1 is connected via a base resistor to the junction between the memory capacitor C3 and the zener diode ZD1. Emitter resistor R5 of the transistor Q1 is provided in the form of a variable resistor whose resistance value is varied in accordance with the guide number setting. A transistor Q2 is adapted to become conductive, when the integrating capacitor C4 is charged to a reference level dependent on resistor R6, while resistors R8, R9 are connected to the collector of transistor Q2. When transistor Q2 becomes conductive, then the potential at the junction between resistors R8 and R9 rises rapidly to a given level. The junction between resistors R8 and R9 is connected to the gate of SCR7, and when the potential at that junction rises, then SCR7 is triggered. Capacitor C5 and zener diode ZD2 form a voltage stabilizing circuit, and a voltage is impressed across them from the electric power source for the aforesaid light control circuit 5, simultaneously with the commencement of light emission of xenon discharge tube Xe. Resistors R10 and R11 respectively discharge memory capacitor C3 and integrating capacitor C4.

The operation of the embodiment of the aforesaid arrangement is as follows. When the main capacitor C1 is charged at a rate commensurate with the voltage of the electric power source 1, a voltage V1 of a level commensurate with the voltage of the main capacitor appears at the junction between the resistors R3 and R4. The capacitor C3 is charged to a potential V2 which is lower than voltage V1 by a given voltage. When synchro-switch S2 is closed under the above condition, then SCR3 is rendered conductive under the action of trigger circuit 4, so that main capacitor C1 is discharged via xenon discharge tube Xe, thereby causing xenon discharge tube Xe to begin emitting light. A voltage is applied from electric power source 6 across a series connection consisting of the integrating capacitor C4, the transistor Q1 and the resistor R5, so that the transistor Q1 starts operating. Hence a current IC of an amount commensurate with charge voltage V2 of the memory capacitor C3 and resistance value of the resistor R5 flows through the collector of the transistor Q1, and then the integrating capacitor C4 is charged with the current IC. When potential Vc of the integrating capacitor C4 reaches the reference level Vs, then the transistor Q2 becomes conductive, so that the potential at the junction between resistors R8 and R9 rises rapidly, so SCR 7 is triggered, and SCR 3 is cut off under the action of commutation capacitor C2, thereby interrupting the light emission of xenon discharge tube Xe. Thus, the light-emitting duration of xenon discharge tube Xe is dependent on the amount of charge current IC for the inegrating capacitor C4, i.e., potential V2 on memory capacitor C3 and a resistance value of resistor R5. The potential V1 at the junction between the resistors R3 and R4 rapidly decreases due to the discharge of main capacitor C1. However, as has been described earlier, the time constant of the circuit consisting of the memory capacitor C3, and the resistor R4 is set to a large value, so that voltage V2 on memory capacitor C3 is maintained constant for a while after the commencement of the discharge of main capacitor C1, and will not be lowered, until the charge potential Vc on the integrating capacitor C4 reaches reference level Vs. Accordingly, the amount of charge current IC for the integrating capacitor C4 may be maintained constant for a while after the discharge of main capacitor C1.

Figure 5:
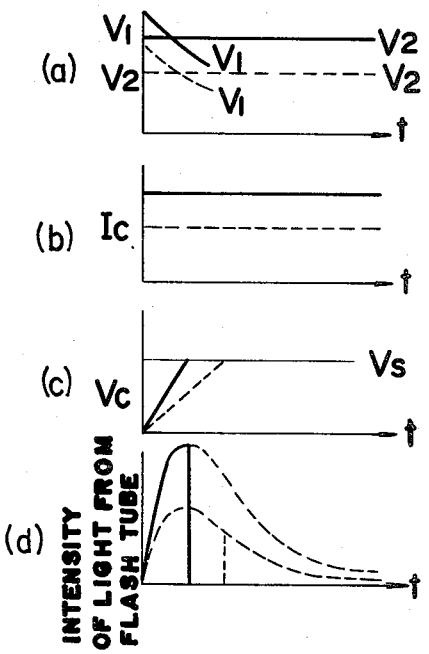
FIG. 5 (*a*), (*b*), (*c*) and (*d*) show respectively a variation in potentials V1 and V2 of the main capacitor upon discharging, in the embodiments of FIGS. 3 and 4 versus time, a variation in a charge current for an integrating capacitor C4 versus time, and a variation in intensity of light-emitted form a xenon discharge tube (Xe)

FIGS. 5 (*a*), (*b*), (*c*) and (*d*) show a variation in potential V1, V2 versus time, a variation in charge current IC for the integrating capacitor C4 versus time, a variation in charge potential Vc for integrating capacitor C4 versus the time, and a variation of the intensity of emitted light of xenon discharge tube Xe. It is to be noted that as in the case of FIGS. 2(*a*), (*b*), (*c*) and (*d*), solid lines therein represent the case where main capacitor C1 is charged sufficiently, and broken lines refer to the case where main capacitor C1 is not charged sufficiently. Further, these figures refer to the case where the guide number, i.e., a resistance value of resistor R5, is set to a given value. In case the main capacitor C1 is not charged sufficiently, values V2 and Ic are both small, Vc varies slightly, so that the light-emitting duration of xenon discharge tube Xe is extended. Stated differently, although the quantity of light emitted from xenon discharge tube Xe per a unit time is less, the total quantity of light emitted from xenon discharge tube Xe is substantially equal to the quantity of light obtained in the case where main capacitor C1 is charged sufficiently, due to the fact that the above decrease in light quantity may be compensated for by extension of the light-emitting time. As a result, even if the charging of main capacitor C1 is delayed, there may be obtained the quantity of light commensurate with the set guide number, permitting an optimum exposure all the time.

In this embodiment, the charge potential at main capacitor C1 before discharge is detected by resistors R3 and R4 which are connected parallelly therewith, and the detected value is stored in memory capacitor C3, thereby avoiding the inconvenience of lowering the light-emitting efficiency of xenon discharge tube Xe. Additionally, a complex construction and adjustment are not required as in the case where a light receiving element receives the light from xenon discharge tube Xe, followed by integration of the received light.

In this embodiment, as shown by a broken line in FIG. 4, in case light-receiving element P, adapted to receive light reflecting from an object, is provided in parallel with transistor Q1 and resistor R5, and then either one of the light receiving element P and a series connection consisting of transistor Q1 and resistor R5 is selectively connected to the integrating capacitor C4 due to the switching operation of switch S3, the electronic flash device according to this embodiment may provide the function of an automatic light control electronic flash device. For the case where there is provided an automatic light control electronic flash device which has a light receiving element P connected in series with an integrating capacitor C4, this flash device may afford a function of an electronic discharge device according to this embodiment, only by adding thereto resistors R3, R4, R5 and R6, memory capacitor C3, zener diode ZD1, transistor Q1 and switch S3.

Figure 6:
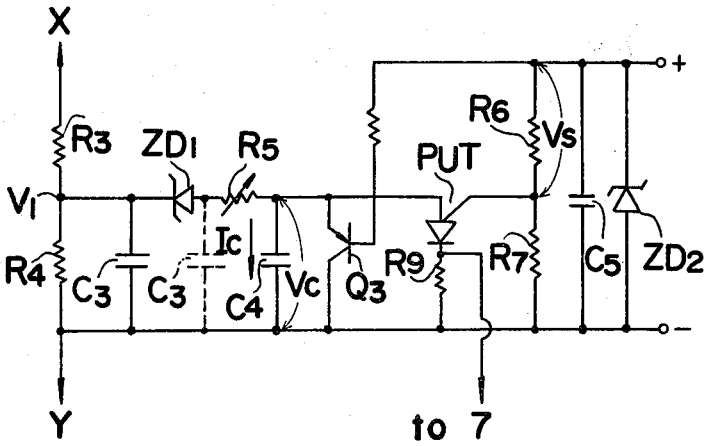
FIG. 6 is a circuit diagram of a light control circuit 5 for the second embodiment.

FIG. 6 shows a light control circuit of the second embodiment of the invention. Like parts are designated like reference numerals for common use with FIG. 4.

Figure 2:
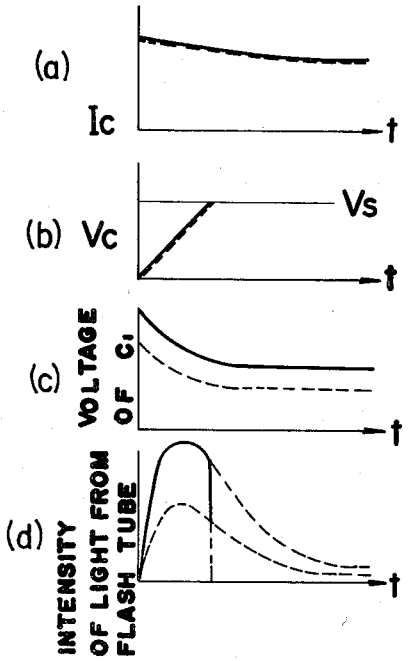
FIG. 2 (*a*), (*b*), (*c*) and (*d*) are plots respectively illustrative of variations in a charge current for an integrating capacitor C in the electronic flash device of FIG. 1 versus time, a variation in charge voltage for the integrating capacitor C versus time, a variation in charge voltage for the integrating capacitor C versus time, and the variation of intensity of light-emitted from an electronic flash tube.

The feature of this embodiment lies in that in place of transistor Q2 of FIG. 2, a programmable uni-junction-transistor PUT is used, and the capacitor C3 is used as an electric power source for charging capacitor C1. In other words, memory capacitor C3 is directly connected across the resistor R4, and charged to the potential V1 at the junction between resistors R3 and R4. However, the integrating capacitor C4 and the transistor Q3 are connected parallelly across the memory capacitor C3 via zener diode ZD1 and variable resistor R5. In this respect, the zener diode ZD1 serves to substract a given voltage from the voltage across the capacitor C3 so that the substracted voltage is applied to one end of resistor R5, while a potential V2 in the embodiment of FIG. 6 appears at the junction between the zener diode ZD1 and the resistor R5. The arrangement of the memory capacitor C3, may be replaced by an arrangement as shown by a broken line wherein the memory capacitor C3 is positioned between zener diode ZD1 and resistor R5. Transistor Q3 has its base connected to a positive terminal of electric power source 6 via a base resistor, so that when a voltage is applied thereto from electric power source 6, then transistor Q3 is cut off, thereby allowing the charging of capacitor C4. Uni-junction transistor PUT has its gate connected between resistors R6 and R7, its anode connected to a positive terminal of integrating capacitor C4 and its cathode connected to resistor R9, respectively. Accordingly, when the potential Vc on the integrating capacitor C4 reaches a reference voltage, uni-junction transistor PUT becomes conductive, thereby forming a discharge path for the integrating capacitor C4, allowing the development of voltage across resistor R9 for triggering SCR7. Meanwhile, before a voltage is impressed from electric power source 6, transistor Q3 remains conducting thereby shortcircuiting integrating capacitor C4 for discharging all charges therefrom.

In this embodiment, as has been described earlier, potential V2 is derived at a junction between the zener diode ZD1 and the resistor R5, and the integrating capacitor C4 begins to be charged simultaneously with the cut-off of transistor Q3 i.e., firing of the xenon tube Xe, with the current Ic dependent on the potential V2 and the resistance value of the resistor R5. When the potential Vc at the integrating capacitor C4 reaches a reference level Vs, then uni-junction transistor PUT becomes conducting, and SCR 7 is triggered, so that xenon discharge tube Xe stops emitting light as in the preceding embodiments. The amount of current Ic for charging integrating capacitor C4 is dependent of the potential on the main capacitor C1 and the resistance value of the resistor R5. Thus, under a condition where a guide number is set, as shown in FIG. 5(*d*), the less the charge on main capacitor C1, the longer the light-emitting duration of xenon discharge tube Xe.

Figure 7:
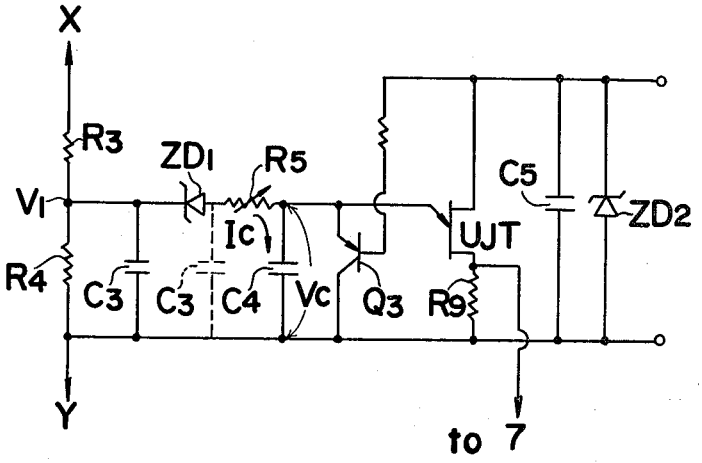
FIG. 7 is a circuit diagram of a light control circuit 5 in the third embodiment.

FIG. 7 shows the third embodiment of the invention, wherein a uni-junction transistor PUT in the embodiment of FIG. 6 is replaced by uni-junction transistor UJT, which has its emitter connected to a positive terminal of integrating capacitor C4, and each of its base terminals connected to a positive terminal and a negative terminal of electric power source 6. The cut-off voltage UJT is of a value inherent thereto. When the integrating capacitor C4 reaches charge potential Vc, then UJT is rendered conductive, and SCR 7 is triggered.

Description has been thus far given of the present invention with the embodiments shown in the drawings. However, the present invention is by no means limited to the aforesaid embodiments.

Figure 8:
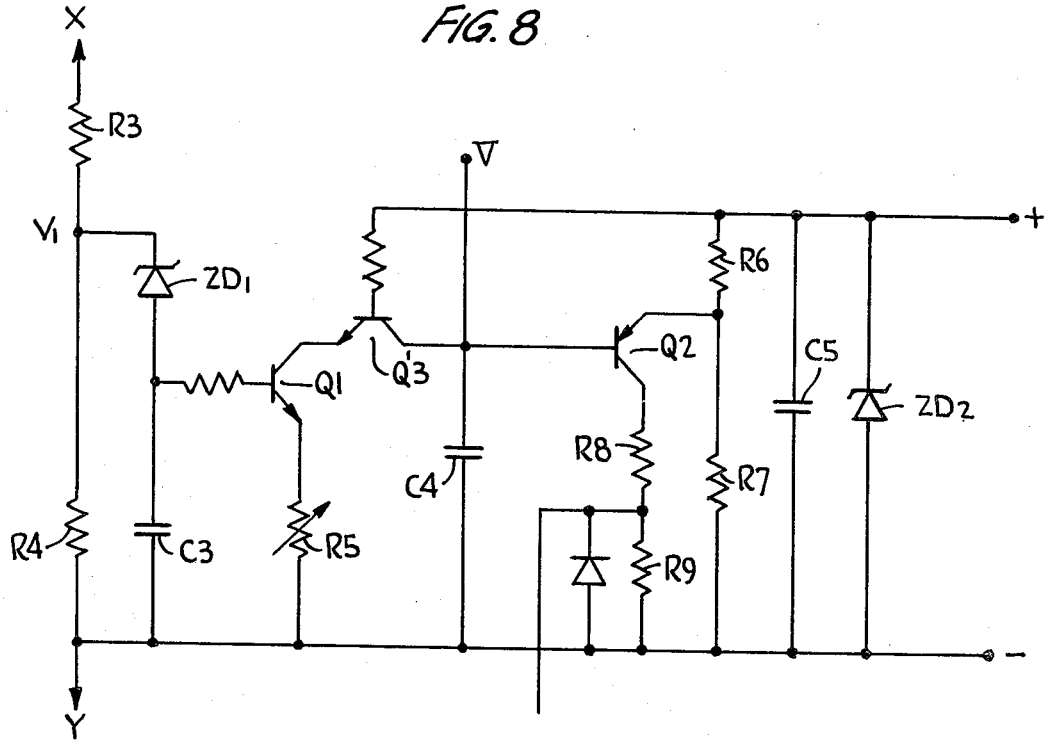
FIG. 8 is a modification of the light control circuit embodiment illustrated in FIG. 7.

For instance, in the aforesaid embodiments, the integrating capacitor C4 is charged with a current corresponding to a potential for main capacitor C1, and the light-emission of xenon discharge tube Xe is so designed as to be interrupted, when the charge potential on the integrating capacitor C4 reaches a reference level. However, it is possible that integrating capacitor C4 is charged beforehand, is discharged with a current corresponding to the charge potential on main capacitor C1 so that light emission from the flash tube is stopped when the voltage of the integrating capacitor C1 decreases to a given level. This modification is illustrated in FIG. 8 in which the same numeral designations have been utilized as in FIG. 7. With reference to FIG. 8, series connected transistors Q1, Q3 and variable resistor R5 are connected across capacitor C4 which in turn is connected with voltage source V. Capacitor C4 is charged to the level of voltage source V beforehand.

When a voltage appears across zener diode D2 in the same manner as that of FIG. 4, transistor Q3' is rendered conductive to discharge capacitor C4 with a current controlled by the emitter-collector current of Q1. The manner of controlling the current is also the same as in FIG. 4. When the voltage of capacitor C4 decreases to a given level, transistor Q2 is made conductive to produce a voltage at the node between resistors R8 and R9 which is transmitted to SCR7 to stop flash firing. Moreover, in the embodiments shown, SCR 7 is forcibly cut off according to a signal representing the fact that the charge potential of the integrating capacitor C4 reaches a reference level, so that the discharging of main capacitor C1 is stopped to interrupt the light-emission from xenon discharge tube Xe. Alternatively, a bias circuit may be opened in response to the aforesaid signal, thereby allowing the charges on main capacitor C1 to be instantaneously discharged through the bias circuit, thereby interrupting the light-emission of xenon discharge tube Xe. Furthermore, according to the aforesaid embodiments, a time constant of the circuit consisting of resistor R4 and memory capacitor C3 is selected large, so that even after the discharge of main capacitor C1, a charge potential on memory capacitor C3 may be maintained constant for a while. However, in case a diode, which allows current to flow only in the charging direction, is connected in series with a memory capacitor C3, then the memory capacitor C3 may afford a storing function, without setting the time constant to a large value.

What is claimed is:

1. An electronic flash device which is equipped with an electronic flash tube capable of emitting light due to discharge of a main capacitor, comprising:

means for storing a signal corresponding to a potential in said main capacitor at a time before the emission of light from said electronic flash tube;

a current supply circuit for supplying a current commensurate with the stored signal, simultaneously with the starting of emission of light from said electronic flash tube, the current level being proportional to the potential of said main capacitor but substantially independent of the emitted light;

an integrating capacitor for integrating the current from said current supply circuit; and a control circuit for interrupting the emission of light from said electronic flash tube when the charge potential on said integrating capacitor reaches a given level to maintain the total amount of light emitted from said flash tube constant with different potentials of said main capacitor.

2. An electronic flash device, as set forth in claim 1, wherein said current supply circuit includes a charging circuit for charging said integrating capacitor with a current corresponding to the signal stored in said storing means.

3. An electronic flash device as set forth in claim 2, wherein said charging circuit includes a transistor connected in series with said integrating capacitor and supplying to said integrating capacitor a current corresponding to the signal stored in said storing means; and an electric power source circuit for energizing a series connection of said integrating capacitor and transistor, simultaneously with the emission of light from said electronic flash tube.

4. An electronic flash device as set forth in claim 2, wherein said storing means includes a storing capacitor; and said current supply circuit includes a circuit for connecting the terminals of said storing capacitor to the terminals of said integrating capacitor, and switch means for short circuiting said integrating capacitor, until the commencement of emission of light from said electronic flash tube.

5. An electronic flash device as set forth in claim 1, further comprising a resistor for introducing a set guide number into said current supply circuit, said current from said current supply circuit being dependent on the resistance value of said resistor.

6. An electronic flash device as set forth in claim 1, wherein said current supply circuit includes a discharge circuit for discharging said integrating capacitor with a current corresponding to the signal stored in said storing means.

* * * * *